United States Patent [19]

Kowalczyk

[11] Patent Number: 4,704,035

[45] Date of Patent: Nov. 3, 1987

[54] REMOTELY TRANSMITTING BATCH MIXER

[75] Inventor: James E. Kowalczyk, Saginaw, Mich.

[73] Assignee: Baker Perkins, Inc., Saginaw, Mich.

[21] Appl. No.: 916,021

[22] Filed: Oct. 6, 1986

[51] Int. Cl.[4] ..... B01F 15/00

[52] U.S. Cl. ..... 366/142; 366/288; 366/601

[58] Field of Search ..... 366/139, 142, 287, 288, 366/601, 348, 349

[56] References Cited

U.S. PATENT DOCUMENTS

| | | | |
|---|---|---|---|
| 3,075,746 | 1/1963 | Yablonski | 366/288 |
| 4,403,867 | 9/1983 | Duke | 366/142 |
| 4,436,431 | 3/1984 | Strong | 366/142 |
| 4,549,812 | 10/1985 | Bothorel | 366/142 |
| 4,576,089 | 3/1986 | Chauvin | 366/142 |

*Primary Examiner*—Robert W. Jenkins

*Attorney, Agent, or Firm*—Learman & McCulloch

[57] ABSTRACT

A remotely transmitting batch mixer has a bowl and a shaft carrier mounting shafts with mixers which mix material in the bowl. Drive mechanism revolves the carrier about an axis generally centrally aligned with the axis of the bowl to move the shafts relatively orbitally about the bowl, and at the same time revolves them about their individual axes. A static enclosure, which mates with the bowl, is provided for the carrier and drive mechanism. Sensor mechanism responsive to the temperature of the material in the bowl and/or to loads applied to one of the shafts is mounted on one of the shafts and connects with slip ring mechanism and an electromagnetic signal transmitter mechanism on the revolving carrier and a signal receiver mounted on the static enclosure.

11 Claims, 2 Drawing Figures

REMOTELY TRANSMITTING BATCH MIXER

BACKGROUND OF THE INVENTION

This invention relates to batch mixers, and particularly to mixers for critical materials such as high energy fuels which are potentially explosive. Typical mixers of this character are described in the present assignee's U.S. Pat. No. 3,075,746 and provide off-axis mixer shafts with intermeshing blades thereon extending into a static mixing bowl. In such mixers, the shafts typically orbit in the bowl at the same time they are rotating about their own axes. Moreover, the shafts and operating mechanisms are enclosed by a static enclosure and releasably sealably connected to the jacketed bowl.

SUMMARY OF THE INVENTION

To permit monitoring of the physical and chemical dynamics of the mixing process, the present mixer is provided with sensors which are reactive to certain characteristics of the mass being mixed over the duration of the mixing cycle. Such sensors, and the sensor circuits associated with them, are mounted on one of the mixer paddles or paddle shafts and transmit electrical signals to signal transmitters which revolve with the shaft-carrier. Each signal transmitter, in turn, broadcasts the signal to a receiving antenna located on the exterior static mixer enclosure which can be connected to suitable monitors and/or alarms.

One of the prime objects of the present invention is to provide a very practical and efficient method of monitoring batch temperatures and/or mixing loads as exemplified by the torque and bending forces applied by the batch to the mixer paddles or paddle shafts as they operate in the mass being mixed.

Another object of the invention is to provide mixers of the general character described with the capability of transmitting information which can be compared with predetermined parameters for the purpose of refining the reactive process being carried out in the mixing bowl and better understanding its nature.

A further object of the invention is to provide a method of transmitting batch temperature information which avoids errors caused by the insulative effect of material layering on the bowl wall in a stagnant condition which is not representative of, or sensitive to, dynamic temperature changes in the body of the mass being mixed.

A still further object of the invention is to provide a method of obtaining data related to the mechanical energy being consumed by the mixing process via monitoring and interfacing mixer blade bending and torque loads.

Another object of the invention is to provide apparatus for more accurately measuring the temperature of a process mass while the mass is in a dynamic mixing mode.

Figure 1:
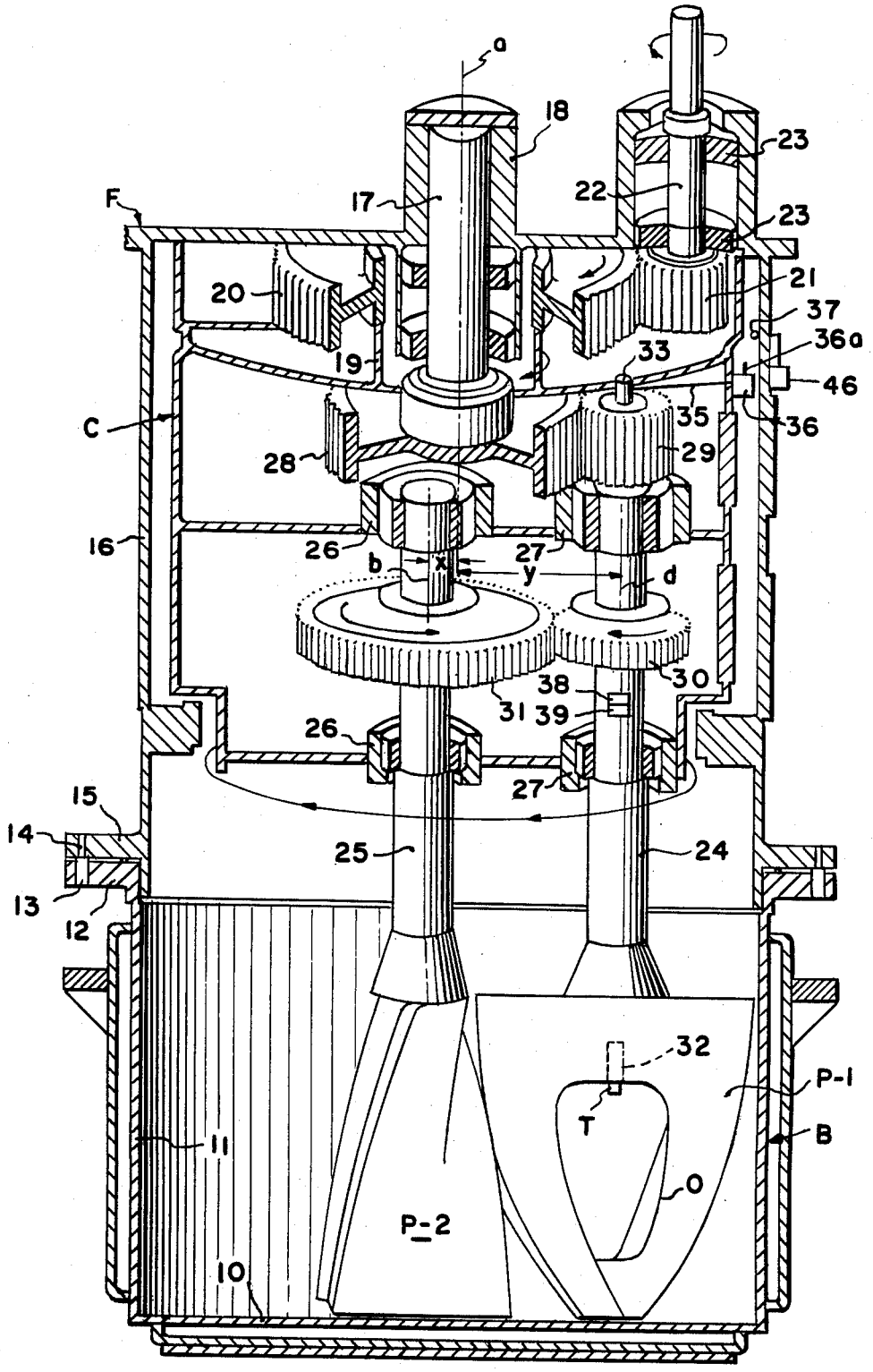
Figure 2:
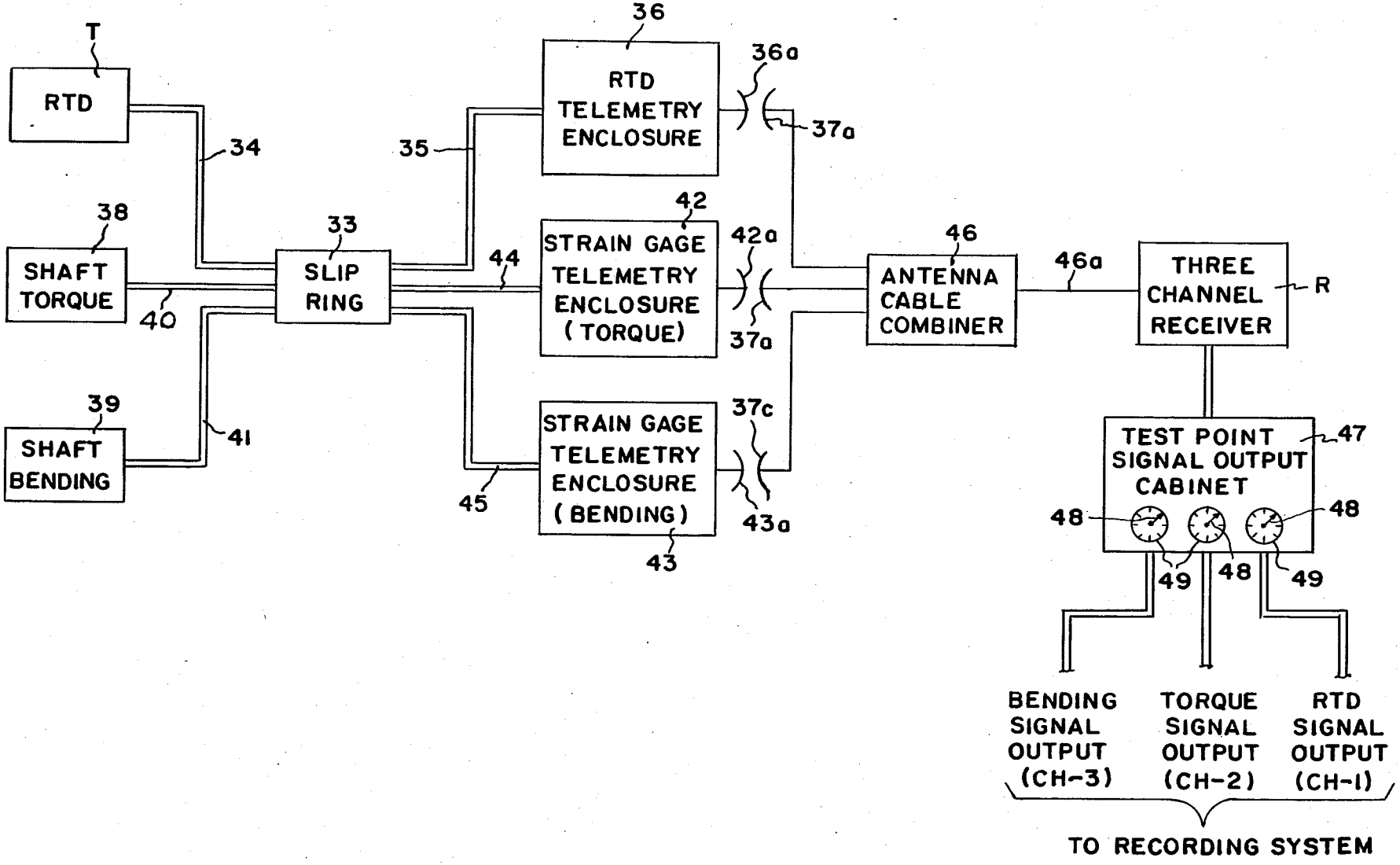

Other objects and advantages of the invention will be pointed out specifically or will become apparent from the following description when it is considered in conjunction with the appended claims and the accompanying drawings, wherein:

FIG. 1 is a schematic, perspective, sectional elevational view of the mixer; and FIG. 2 is a schematic circuit diagram identifying various components which make up the information transmitting circuit.

Referring now more particularly to the accompanying drawings, a batch mixing machine is illustrated which is similar to the mixer disclosed in the aforementioned U.S. Pat. No. 3,075,746, insofar as the mixing elements are concerned.

In that patent a bowl B is provided which includes a jacketed bottom wall 10, and a jacketed annular side wall 11, the jacketing providing for temperature control of the bowl via the circulation of liquid through the jacketed walls in the usual manner. At its upper end, bowl B has a flange 12, provided with openings 13 which are adapted to align with pins 14 depending from a flange 15, provided on a stationary housing or enclosure member 16. It is to be understood that the bowl B is raisable vertically to and from engaged sealed position, from a lowered position, in the manner disclosed in the aforementioned patent, and that housing 16 is fixed to the frame F of the machine in the manner previously described in the aforementioned patent.

Provided within the housing 16, which is closed except at its lower end, is a rotating carrier assembly, generally designated C, fixed for rotation on a shaft 17 which is centrally, axially supported by frame F in the bearing assembly 18. Fixed to a carrier wall 19, to drive the carrier C in rotation, is a gear 20 which is driven by a drive gear 21 connected with a motor-driven drive shaft 22, journaled in the frame F by bearings 23. Gear 20 drives the carrier C in concentric rotation within the fixed housing 16 about an axis a.

Provided to depend into the mixing bowl B, is a radially outer, high-speed mixing shaft 24, and also a lower speed mixing shaft 25. Shaft 24 has a blade or paddle P-1 fixed to its lower end and shaft 25 has an intermeshing blade or paddle P-2 fixed to its lower end. It will be noted that the shaft 25, which is journaled in bearings 26 supported by the carrier C, has an axis of rotation b, radially off-set a distance x from the axis a of carrier rotation. Shaft 24, which is journaled in bearings 27 fixed to the carrier C, has an axis d which is off-set a greater distance y from the axis of rotation a of carrier C. Both shafts 24 and 25 rotate about their own axes d and b respectively, while simultaneously orbiting in the bowl B about the axis of carrier rotation a. The shaft 24 is driven in rotation about the axis d via a gear 28, fixed to the carrier shaft 17, and in mesh with a gear 29 fixed to the upper end of shaft 24. Gear 30, fixed to shaft 24, then drives shaft 25 about axis b via a gear 31, fixed on shaft 25. It will be noted that the radially outer, higher speed paddle P-1 has an opening O. Provided on the paddle P-1 in the opening O, so as to be sensitive to the temperature of the material extruding through the opening O during the mixing operation is a temperature bulb or sensor T, extending axially to project downwardly slightly into the opening O as shown in FIG. 1. Sensor T is fixed in a bore 32. Sensor T may be a commercially available resistance temperature device or RTD of the type marketed by Thermoelectric Co. Inc. of Saddlebrook, N.J. Wires lead up from the resistance element in temperature sensor T to a slip ring assembly 33 mounted concentrically on top of shaft 24, through the bore 32 in shaft 24. The slip ring assembly 33 is of the type SRM 20M manufactured by Michigan Scientific Corporation of Milford, Mich., and includes a series of terminals which are hard wired as at 35 to an RTD telemetry enclosure box 36 mounted on the outer wall surface of carrier C.

The transmitter enclosure 36, which is commercially available from Hitek Corporation of Westford, Mass., comprises a housing, fixed to rotate with the carrier C, which has its own transmitting antenna 36*a*. The enclosure houses a power pack consisting of a radio wave transmitter, batteries for powering the transmitter, a wheatstone bridge circuit connecting with the resistance element of sensor T to provide a resistor network balanced (for a particular temperature) in a zero voltage transmitting condition, and a bridge power on/off swtich. When the temperature varies, in terms of voltage increase or drop, the bridge circuit becomes unbalanced and a modulated signal is broadcast by the transmitter to a receiving antenna 37, fixed to the interior wall of stationary housing 16.

When only a temperature signal is being transmitted, a single channel receiver, connected to receiving antenna 37, could be utilized. In the present case, a three channel receiver R is employed because it is also desired to obtain signals which are sensitive to torque forces placed on the high speed shaft 24, and to bending forces applied to the shaft 24. Accordingly, also carried by the shaft 24, is a torque sensitive strain gauge 38 and a bending moment sensitive strain gauge 39. These strain gauges, 38 and 39, are high-speed blade strain gauges of the type marketed by Micro-Measurements, Inc. of Raleigh, N.C. Each of these strain gauges includes wheatstone bridge resistance wiring which is sensitive to the position of the blade, and is hard-wired, in the case of the sensor 38 as at 40, to the slip ring assembly 33, and as at 41, in the case of the bending gauge 39. The slip ring assembly 33, of course, has separate terminals for the sets of wires 34, 40 and 41, and these terminals are separately hard-wired to the strain gauge telemetry enclosure for torque 42, and the strain gauge telemetry enclosure for bending 43, by sets of wires 44 and 45, respectively. Each of the enclosures 42 and 43 includes the same elements mentioned with respect to enclosure 36, and each also has its own transmitting antenna 42*a* and 43*a*. In the case of enclosures 42 and 43, the resistance connected to the wheatstone bridge network provided in the strain gauge sensors 38 and 39 is a bridge balance. While only the enclosure 36 is shown in FIG. 1, it is to be understood that the enclosures 42 and 43 are likewise fixed to the carrier C at selected, spaced circumferential intervals from the enclosure 36. Commercially available (Hitek Corporation of Westford, Mass.) receiving antenna 37 is a three segment antenna having segments 37*a*, 37*b*, and 37*c* for separately receiving the three different frequency signals from antennas 36*a*, 42*a*, and 43*a*. The segments 37*a*, 37*b* and 37*c* are separately connected by coaxial cable to an antenna cable combiner 46 of conventional design (Mini-Circuits laboratory of Brooklyn, N.Y.) which transmits the signal separating to receiver R. Receiver R, which is connected by coaxial cable to the cable combiner 46, and preferably is located remotely from the mixer, is capable of processing up to three channels of transmitted signals, and transferring them to a signal output cabinet 47 which may have movable pointers 48 working in conjunction with fixed scales 49, thus permitting the receiver output signals to be visually separately monitored. The separated signals from signal output cabinet 47 may also be separately wired to an oscillograph recording system to permit a permanent record to be kept on a continuous basis over the batch-mixing cycle.

THE OPERATION

As the shaft 24 rotates about its axis and moves orbitally through the mass, material well inboard of the surface of the bowl and the skin of material which tends to adhere thereto is continuously extruded through the opening O in contact with the temperature sensor T. Sensor T is connected via slip ring assembly 33 to the batteries in enclosure 36 and the wheatstone bridge completion circuit. The circuit is in balance at a designated temperature. With a resistance change at the sensor T, due to a temperature change, the bridge is unbalanced and a voltage signal is transmitted to the transmitter enclosure 36. This signal is chopped and converted to a frequency, and transmitted by the transmitter on the FM band as a modulation of the square wave RF carrier being broadcast by the radio transmitter in enclosure 36. The signal voltage modulates, or changes the voltage amplitute of this square wave signal. The transmitted signal is received by the receiving antenna 37 and passed to the receiver R which demodulates it, i.e., converts it from a square wave frequency to a scaled analog voltage, and then passes it to the test signal enclosure input terminals. The pointer 48 on scale 49 calibrated for temperature, for example, may be moved to indicate the degree of change of temperature measured by the sensor T. While only temperature, of course, may be monitored, the torque and bending forces applied to high speed shaft 24 by the mixer during the batch cycle, may also be monitored. Each strain gauge 38 and 39 is also wired through the slip ring 33 to a d.c. source of battery power in its enclosure 42 or 43, which houses the same components as enclosure 36. When the strain gauge circuits are unbalanced, due to a change in the bending and torque loads applied to shaft 24, a voltage signal modulates the RF carrier wave being broadcast by the transmitter in the manner previously described.

As with the temperature signal, the modulated signal voltages for torque and bending are transmitted to the receiver 37. Receiver 37 transmits signals on separate channels to the signal output cabinet 47 as signal voltages which are applied to the pointers 48 operating with the bending and torque scales 49, and also applies these signal voltages to the separate output terminals of the output cabinet 47.

The information obtained may be individually considered, or plotted to consider variations in all three of the conditions sensed at any point in the mixing cycle.

While one embodiment of the invention has been described in detail, it will be apparent to those skilled in the art that the disclosed embodiment may be modified. Therefore, the foregoing description in all aspects is to be considered exemplary rather than limiting in any way, and the true scope of the invention is that defined in the claims.

What is claimed is:

1. A batch mixer comprising:

a. a bowl having a bottom and a generally axially parallel side wall;

b. a shaft carrier mounting at least a first shaft extending generally axially into said bowl;

c. said shaft having a mixer member thereon;

d. mechanism associated with said carrier for revolving said carrier about an axis operably generally centrally aligned with the axis of the bowl and moving said shaft relatively orbitally about the bowl while revolving said shaft about its individual axis;

e. a static enclosure for said carrier and mechanism having an end wall and a side wall;

f. a sensor mounted on said shaft;

g. slip ring mechanism on said one shaft operably connected to said sensor, as part of a powered circuit;

h. electromagnetic signal transmission means on said revolving carrier electrically connected to said slip ring mechanism as part of said circuit; and i. electromagnetic signal receiving means mounted on said static enclosure.

2. The mixer defined in claim 1 wherein said sensor is sensitive to changes in the temperature of the material being mixed in the bowl.

3. The mixer defined in claim 1 wherein said sensor is mounted off axis on said shaft and is sensitive to the load applied as a counter-torque to the mixer shaft by the material being mixed in the bowl.

4. The mixer defined in claim 1 wherein said sensor is mounted off axis on said shaft and is sensitive to the resistance of the material being mixed as applied to tend to bend said shaft.

5. The mixer defined in claim 1 wherein a second mixer shaft having a mixer received in said bowl is mounted on said carrier off axis with respect to said bowl and is driven in rotation about its own axis by said first shaft at a lower speed of rotation.

6. The mixer defined in claim 1 wherein said electromagnetic signal transmitter is a radio transmitter, and said signal receiving means is a radio wave receiver.

7. The mixer defined in claim 1 wherein monitoring means connects to said receiving means.

8. A method of monitoring mixing processes carried out in a mixer comprising:

a. a bowl having a bottom and a generally axially parallel side wall;

b. a shaft carrier mounting at least a first shaft to extend axially into said bowl;

c. said shaft having a mixer member thereon;

d. mechanism associated with said carrier for revolving said carrier about an axis operably generally centrally aligned with the axis of the bowl and moving said shaft relatively orbitally about the bowl while revolving said shaft about its individual axis;

e. a static enclosure for said carrier and mechanism having an end wall and a side wall;

f. a sensor mounted on said shaft;

g. slip ring mechanism on said one shaft electrically connected to said sensor, as part of a powered circuit;

h. electromagnetic signal transmission means on said revolving carrier electrically connected to said slip ring mechanism as part of said circuit; and i. electromagnetic signal receiving means mounted on said static enclosure;

the steps of:

a. sensing at least one characteristic of the material being mixed in the dynamic portion of the mass being mixed inboard of the material adjacent the bowl, from the group of characteristics comprising mass temperature, and mass load application, and converting it to an electrical signal;

b. transmitting the signal to the rotating transmitter on the carrier within the enclosure;

c. broadcasting the signal; and d. receiving the broadcast signal remotely.

9. The method of claim 8 wherein the signal received is converted to a monitorable flow of data.

10. The method of claim 8 wherein the mixer is of the type having a second mixer shaft, with a mixer received in said bowl, which is mounted on said carrier and driven in rotation about its own axis at a slower rate of rotation than said first shaft, and it is the characteristic of the higher speed shaft which is sensed.

11. The method of claim 10 in which mass temperature, and the load applied by the mass to said high speed shaft in torque and in bending are simultaneously sensed, broadcast, and received.

* * * * *